US006406362B1

(12) United States Patent
Yednak, III et al.

(10) Patent No.: US 6,406,362 B1
(45) Date of Patent: Jun. 18, 2002

(54) SEAL FOR USE WITH A CHEMICAL MECHANICAL PLANARIZATION APPARATUS

(75) Inventors: Andrew Yednak, III, Phoenix; Phillip M. Rayer, II, Chandler, both of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/754,449

(22) Filed: Jan. 4, 2001

(51) Int. Cl.[7] ..... B24B 37/04
(52) U.S. Cl. ..... 451/287; 451/53; 451/450
(58) Field of Search ..... 451/41, 53, 287, 451/450, 488

(56) References Cited

U.S. PATENT DOCUMENTS 5,738,574 A * 4/1998 Tolles et al. ..... 451/287 X
5,804,507 A 9/1998 Perlov et al.
5,876,265 A 3/1999 Kojima
5,954,912 A 9/1999 Moore
6,033,290 A 3/2000 Gurusamy et al.
6,071,184 A 6/2000 Anderson, III
6,156,124 A * 12/2000 Tobin ..... 118/719
6,165,058 A * 12/2000 Zuniga et al. ..... 451/287
6,250,813 B1 * 6/2001 Thibault ..... 384/495

* cited by examiner

*Primary Examiner*—Joseph J. Hail, III
*Assistant Examiner*—Anthony Ojini
(74) *Attorney, Agent, or Firm*—Snell & Wilmer, L.L.P.

(57) ABSTRACT

The present invention provides a labyrinth seal for use with a workpiece planarization apparatus, such as a chemical mechanical planarization apparatus. In accordance with one aspect of the invention, there is provided a labyrinth seal comprising a member having at least one sloped feature which is configured to inhibit a fluid from traveling into and through the labyrinth. In accordance with another aspect of the invention, there is provided a workpiece polishing apparatus including a rotary shaft assembly which comprises a housing having a plurality of interior components; a shaft extending longitudinally through the housing, wherein the shaft includes a first end connected to a motor for rotating the shaft relative to the housing; a platen connected to a second end of the shaft; and a labyrinth seal located in a space between the platen and the housing, wherein the labyrinth seal comprises a member having at least one sloped feature which is configured to inhibit a fluid from traveling into and through the labyrinth seal. In accordance with yet another aspect of the invention, there is provided a labyrinth seal having at least one sloped feature, wherein the labyrinth seal is coupled to a fluid purge system including a purge line connected to a source of pressurized fluid and terminating in the labyrinth seal.

26 Claims, 5 Drawing Sheets

SEAL FOR USE WITH A CHEMICAL MECHANICAL PLANARIZATION APPARATUS

FIELD OF THE INVENTION

The present invention generally relates to apparatus for polishing or planarizing workpieces, such as silicon wafers, and, more particularly, to a seal used in conjunction with such apparatus.

BACKGROUND OF THE INVENTION

In the semiconductor manufacturing industry, silicon workpieces are used as substrates for the fabrication of integrated circuit components. The workpieces, known in the industry as "wafers", typically are sliced from an elongated cylinder, or bole, of single crystal silicon, and they generally have a flat, circular, disk-like shape. During the fabrication process, the wafers usually undergo multiple masking, etching, and dielectric and conductor deposition processes to create microelectronic structures and integrated circuitry on the wafers. Since the character of the substrate surface may substantially impact the quality of the integrated circuitry formed upon that surface, careful preparation of the wafer surface is usually necessary throughout the various stages of the semiconductor fabrication process. Moreover, as rapid evolution in the industry provides a continual impetus for diminishing the size of integrated circuits while heightening the density of the microelectronic structures forming each circuit, the need for precise preparation of wafer surfaces becomes evermore critical in the fabrication of high-quality semiconductors.

The extremely precise surface configuration of the substrates used in the production of integrated circuit components generally can be obtained by appropriately planarizing or polishing the substrate surface. Chemical mechanical planarization or polishing (CMP) machines have been developed for this purpose and are used to ensure that the substrate is free from projections or other imperfections which might adversely affect the accuracy and performance of the microelectronic structures formed thereupon. Such CMP machines and processes are well known in the art and are commercially available. For a discussion of CMP processes and apparatus, see, for example, Arai, et al., U.S. Pat. No. 4,805,348, issued February, 1989; Arai, et al., U.S. Pat. No. 5,099,614, issued March, 1992; Karlsrud et al., U.S. Pat. No. 5,329,732, issued July, 1994; Karlsrud, U.S. Pat. No. 5,498,196, issued March, 1996; and Karlsrud et al., U.S. Pat. No. 5,498,199, issued March, 1996.

Conventionally, a CMP polishing apparatus includes a rotatable platen and a wafer carrier which each rotate about their respective vertical axes at individually selected speeds. As seen in FIGS. 1 and 2, a conventional abrasive polishing pad 126 is attached to the upper surface of a rotatable platen 128 which rotates by means of a rotary shaft (not shown). An upper portion of the rotary shaft is connected to the rotatable platen 128 and a lower portion of the rotary shaft is connected to a motor (not shown) which rotates the shaft as needed. A semiconductor wafer seated in the wafer carrier 124 is lowered into engagement with the polishing pad 126 and clamped between the carrier 124 and the rotatable platen 128, typically through the exertion of downward force by the carrier 124. The polishing pad 126 polishes the wafer surface by rotating when the wafer is brought into engagement with the polishing pad 126 by wafer carrier 124. A liquid containing an abrasive, granular material, known as a slurry, is deposited onto and retained by the polishing pad

126. During operation of the CMP apparatus, the wafer carrier 124 exerts pressure on the rotatable platen 128, and the surface of the semiconductor wafer held against the polishing pad 126 is thereby planarized and/or polished by a combination of chemical planarization and/or polishing by the slurry and mechanical planarization and/or polishing by the pad 126 as the carrier 124 and the rotatable platen 128 are rotated, respectively.

The rotatable platen that supports the polishing pad typically is mounted to, supported upon, and rotated by a rotary shaft that is coupled to a motor. A conventional rotary shaft assembly is illustrated in FIG. 3. The rotary shaft assembly 300 includes a rotary shaft 302 which passes through a hollow, non-rotatable housing 304 having a plurality of interior components, such as internal bearings 306 which support the shaft 302 and permit relative rotation between the shaft 302 and the housing 304; spacers 308; and seals (not shown). In order for the rotary shaft 302 to rotate about its vertical axis while supporting the platen 128 above the non-rotatable housing 304, a void space or pocket 310 exists between a portion 301 of the rotary shaft 302 and an upper portion 305 of the assembly housing 304. Typically, the void space 310 comprises a conventional step-tooth labyrinth seal 312 formed between portion 301 of the rotary shaft 302 and upper portion 305 of the assembly housing 304. The particular configuration of labyrinth seal 312 is intended to prevent fluid, such as slurry, introduced onto the polishing pad 126 during the polishing process, from entering the assembly housing 304.

During the polishing process, slurry frequently flows off the polishing pad 126 in the direction of arrow 314 and collects or pools at the opening of the labyrinth seal 312. As the process continues, the heat generated by the rotation of the shaft 302 results in an increase in the temperature within the assembly housing 304. This increased temperature frequently results in an eventual build-up of negative pressure within the assembly housing 304 as the components within the assembly housing 304 cool, which build-up of negative pressure effects a suction force on the slurry which has collected at the opening of the labyrinth seal 312. Consequently, the slurry is drawn through the labyrinth seal 312 and into the housing 304 of the rotary shaft assembly 300, where the slurry then gets trapped between the rotary shaft 302 and the internal bearings 306, seals (not shown), and/or other stationary components of the assembly 300. Any slurry which is interposed between or among the interior components of the rotary shaft assembly 300, such as the bearings 306 for example, has a potentially corrosive and/or degenerative effect on the components which tends to cause premature and excessive wear as well as damage that compromises the functioning of the apparatus.

Presently known rotary shaft labyrinth seals are unsatisfactory in several regards. Specifically, prior art devices have proved to be ineffective at preventing abrasive or corrosive chemical slurry, slurry vapor, and other fluids from entering the shaft assembly and deteriorating or destroying the interior components of the assembly. For example, during the polishing process, the step-tooth design of current labyrinth seals permits slurry to collect in the valley created by the labyrinth opening. As the temperature naturally rises and falls within the housing of the rotary shaft assembly over the course of the polishing process, a negative pressure within the assembly housing is created, and the slurry which has collected in the opening of the labyrinth is drawn through the labyrinth and into the assembly housing. The slurry then gets trapped between the rotary shaft and the internal bearings, seals, and/or other stationary internal components of the assembly. Since typical CMP shaft assemblies do not permit post-manufacture application of additional grease to the internal bearings in the shaft assembly, deterioration and corrosion caused by slurry and/or slurry vapor entering the assembly effectively shortens the useful life of the bearings and therefore of the rotary shaft assembly. Moreover, the gradual deterioration and particle degeneration of various assembly components ultimately may contaminate the polishing process and compromise the overall quality of the wafer fabrication process. Consequently, deficiencies in prior art labyrinth seals likely contribute significantly to premature wear and damage of assembly components, incrementally inferior machine performance, and, eventually, destruction of the rotary shaft assembly, all of which generally result in increased machine down-time and maintenance costs, decreased wafer throughput, and, ultimately, increased wafer fabrication costs.

In view of the foregoing, a need exists for a seal which overcomes the shortcomings of the prior art. Thus, there is a need for a seal which inhibits slurry, slurry vapor, and other fluids associated with substrate finishing processes from entering the rotary shaft assembly. There is also a need for a seal which inhibits fluids, slurry, and slurry vapor from collecting at the opening of the labyrinth and then being drawn through the labyrinth and into the shaft assembly as the temperature of the shaft assembly rises and falls during the polishing process. Additionally, there is a need for a seal which inhibits corrosion and deterioration of the interior components of the shaft assembly by fluids and/or slurry used during the polishing process.

SUMMARY

The present invention provides a seal having improved reliability characteristics, which are useful in apparatus employed in the preparation of substrate surfaces, such as the surfaces of semiconductor wafers. Preliminarily, as used herein, the seal is generally referred to as a "labyrinth seal", though one skilled in the art will appreciate that other types of seals may likewise be substituted and still fall within the ambit of the appended claims. Thus, in accordance with one aspect of the present invention, there is provided a rotary shaft labyrinth seal comprising a member having at least one sloped feature which is configured to substantially inhibit a fluid or other material used in substrate processing from entering into the labyrinth seal and contacting the interior components of the rotary shaft assembly during or after a substrate preparation process. In an exemplary embodiment, the labyrinth seal comprises a sloped surface having a base and an apex, wherein the base juxtaposes the opening of the labyrinth seal. In another exemplary embodiment, the labyrinth seal comprises a sloped surface having an apex and a base, wherein the base juxtaposes the opening of the labyrinth seal; and a surface, wherein the surface extends outwardly from the base and toward the opening or entry of the labyrinth seal.

In accordance with another aspect of the invention, a labyrinth seal is used in conjunction with a wafer polishing apparatus, such as a chemical planarization apparatus. In one exemplary embodiment, there is provided a workpiece polishing apparatus including a rotary shaft assembly which comprises a housing having a plurality of interior components; a shaft extending longitudinally through the housing, wherein the shaft includes a first end connected to a motor for rotating the shaft about its vertical axis; a platen connected to a second end of the shaft; and a labyrinth seal located in a space between the second end of the shaft and the housing, wherein the labyrinth seal comprises a member having at least one sloped feature which is configured to inhibit a fluid or other material used in substrate processing from entering into the labyrinth seal and contacting interior components of the rotary shaft assembly during or after a substrate preparation process.

Other features and advantages of the present invention will become apparent to those skilled in the art from the following detailed description. It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications.

BRIEF DESCRIPTION OF THE DRAWINGS

The features and advantages of the present invention reside in the details of construction and operation as more fully depicted, described, and claimed hereinafter; reference being had to the accompanying drawings forming a part hereof, wherein like numerals refer to like parts throughout, and wherein

DETAILED DESCRIPTION OF EXEMPLARY EMBODIMENTS

The following detailed description of exemplary embodiments of the present invention makes reference to the accompanying drawings, which form a part hereof and in which are shown, by way of illustration, exemplary embodiments in which the invention may be practiced. These exemplary embodiments are described in sufficient detail to enable those skilled in the art to practice the invention, and it should be understood that other embodiments may be utilized and that logical, mechanical, and electrical changes may be made without departing from the spirit and scope of the present invention. Thus, the following detailed description is presented for purposes of illustration only and not of limitation, and the scope of the present invention is defined solely by the appended claims.

Figure 1:
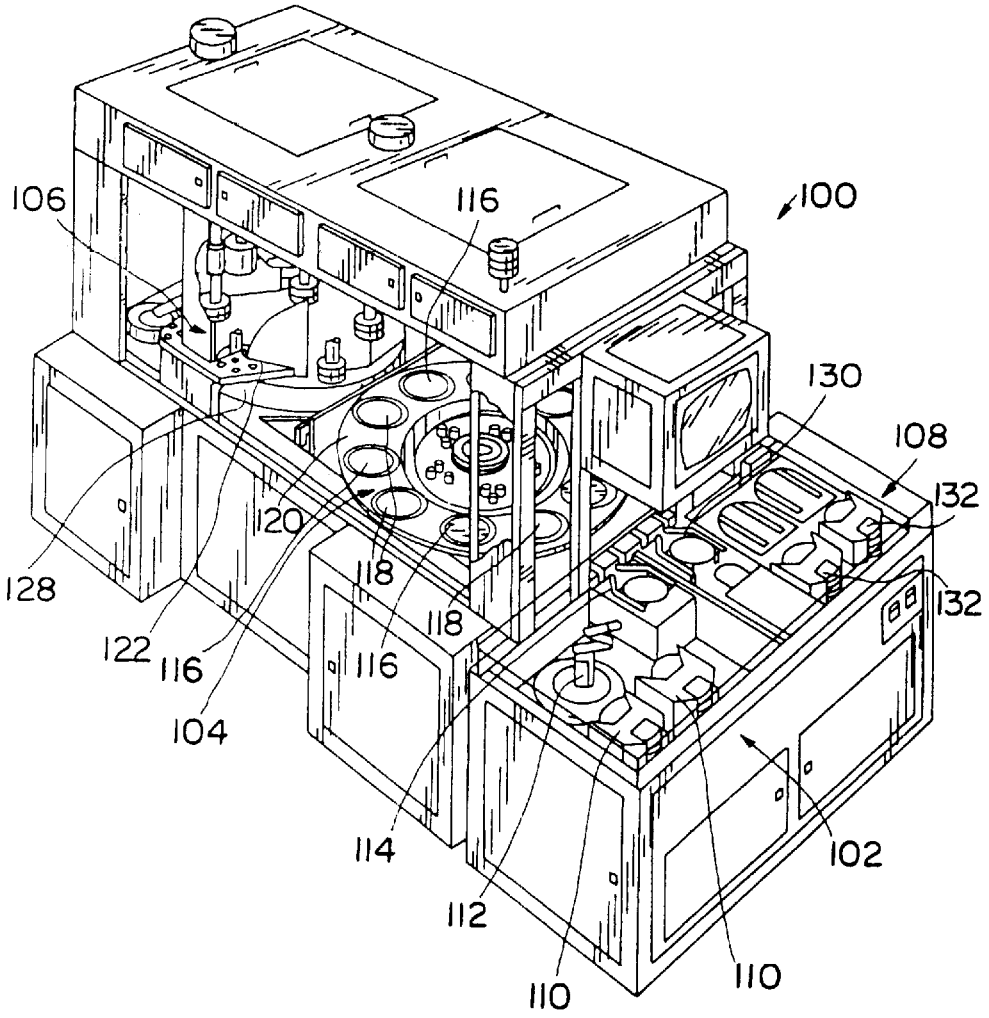
PRIOR ART FIG.1
FIG. 1 is a perspective view of a conventional substrate finishing apparatus which may incorporate the rotary shaft labyrinth seal of the present invention.
Figure 2:
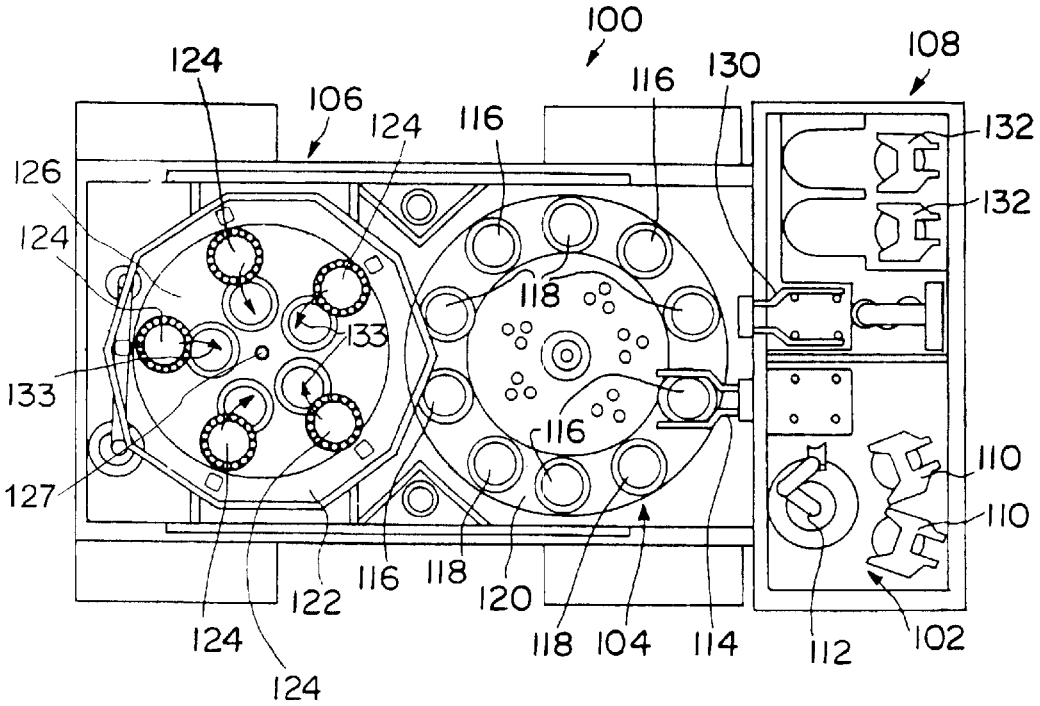
PRIOR ART FIG.2
FIG. 2 is a top view of the apparatus of FIG. 1.
Figure 3:
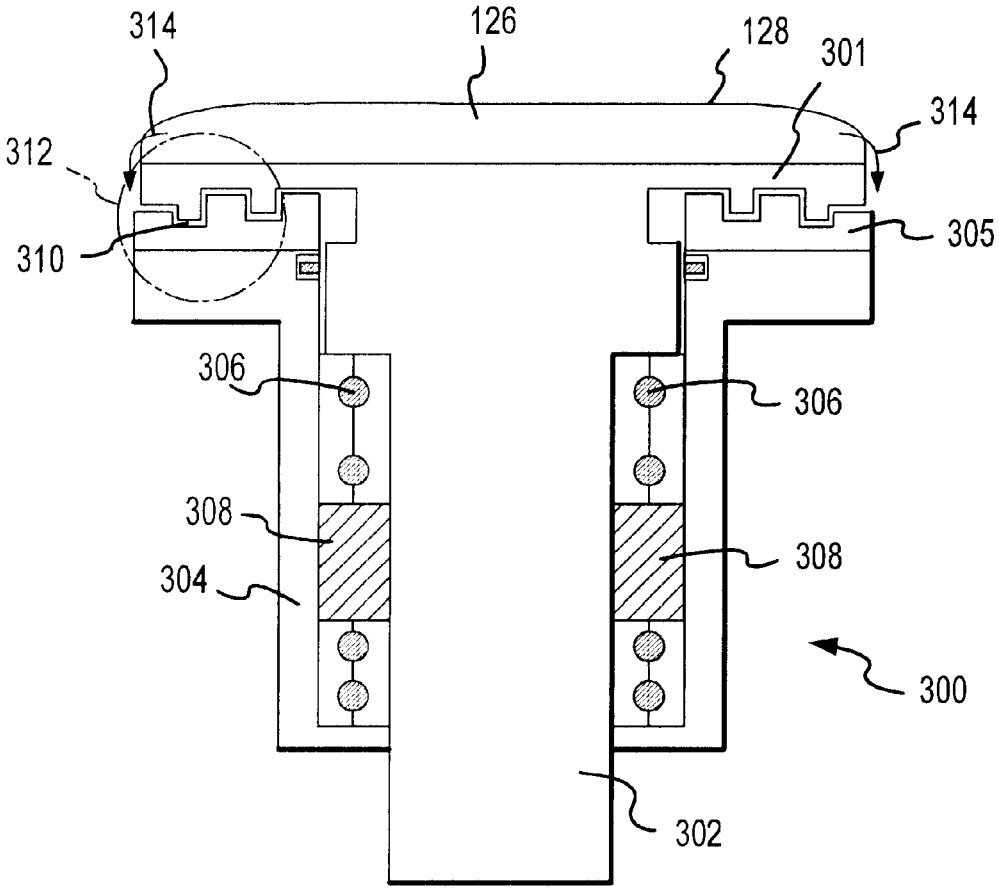
PRIOR ART FIG.3
FIG. 3 is a cross-sectional view of a rotary shaft assembly incorporating a conventional step-tooth rotary shaft labyrinth seal.

Referring now to the drawings, FIGS. 1 and 2 depict a conventional semiconductor wafer polishing apparatus 100. The multiple-head wafer polishing apparatus 100 represents an exemplary workpiece polishing apparatus which can be adapted for use with the present invention. It should be understood that the particular CMP machine of FIGS. 1 and 2 is referred to herein for purposes of illustration only and not of limitation. One skilled in the art will appreciate that the present invention may be embodied in any suitable workpiece polishing apparatus having a suitable rotary shaft assembly.

Generally, the exemplary CMP apparatus 100 accepts wafers from a previous processing step, polishes and rinses the wafers, and reloads the wafers back into wafer cassettes for subsequent processing. As depicted in FIG. 1, apparatus 100 comprises an unload station 102, a wafer transition station 104, a polishing station 106, and a wafer rinse and load station 108. The depicted CMP apparatus receives cassettes 110, each holding a plurality of wafers, at unload station 102. Next, a robotic wafer carrier arm 112 removes the wafers from cassettes 110 and places them, one at a time, on a first wafer transfer arm 114. Wafer transfer arm 114 then sequentially lifts and moves each wafer into wafer transition section 104. That is, transfer arm 114 places an individual wafer upon one of a plurality of wafer pick-up stations 116 which reside on a rotatable table 120 within wafer transition section 104. Rotatable table 120 also includes a plurality of wafer drop-off stations 118 which alternate with pick-up stations 116. After a wafer is deposited upon one of the plurality of pick-up stations 116, table 120 rotates so that a new station 116 aligns with transfer arm 114. Transfer arm 114 then places the next wafer on the newly-empty pick-up station 116. This process continues until all pick-up stations 116 are filled with wafers. In the illustrated embodiment, table 120 includes five pick-up stations 116 and five drop-off stations 118.

Next, a multi-head wafer transport apparatus 122, comprising individual wafer carrier elements 124, aligns itself over table 120 so that respective carrier elements 124 are positioned directly above the wafers which reside in respective pick-up stations 116. The multi-head transport apparatus 122 then drops down and picks up the wafers from their respective stations and moves the wafers laterally such that the wafers are positioned above polishing station 106. Once above polishing station 106, transport apparatus 122 lowers the wafers, which are held by individual carrier elements 124, into operative engagement with a polishing pad 126 which sits atop a lap wheel or rotatable platen 128. During operation, rotatable platen 128 causes polishing pad 126 to rotate about its vertical axis. At the same time, individual carrier elements 124 spin the wafers about their respective vertical axes and oscillate the wafers back and forth across pad 126 (substantially along arrow 133) as they press against the polishing pad. Further, a processing solution dispensing apparatus 127 will dispense processing solution, such as a slurry, onto polishing pad 126, to further facilitate the CMP polishing process. In this manner, the under surface of the wafer is polished or planarized.

After an appropriate period of time, the wafers are removed from polishing pad 126, and multi-head transport apparatus 122 transports the wafers back to transition station 104. Transport apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers it to wafer rinse and load station 108. In the load station 108, transfer arm 130 holds the wafers while they are rinsed. After a rinsing step, the wafers are reloaded into cassettes 132, which then transport the wafers to subsequent stations for further processing or packaging.

As will be evident to those skilled in the art, exemplary polishing apparatus 100 may embody any number of configurations and constructions without departing from the scope of the present intention. FIGS. 1 and 2, which illustrate one embodiment of such an apparatus, have been included herein merely to illustrate an exemplary environment in which a rotary shaft labyrinth seal in accordance with the present invention may be used and to assist in clearly describing the invention.

Figure 4A:
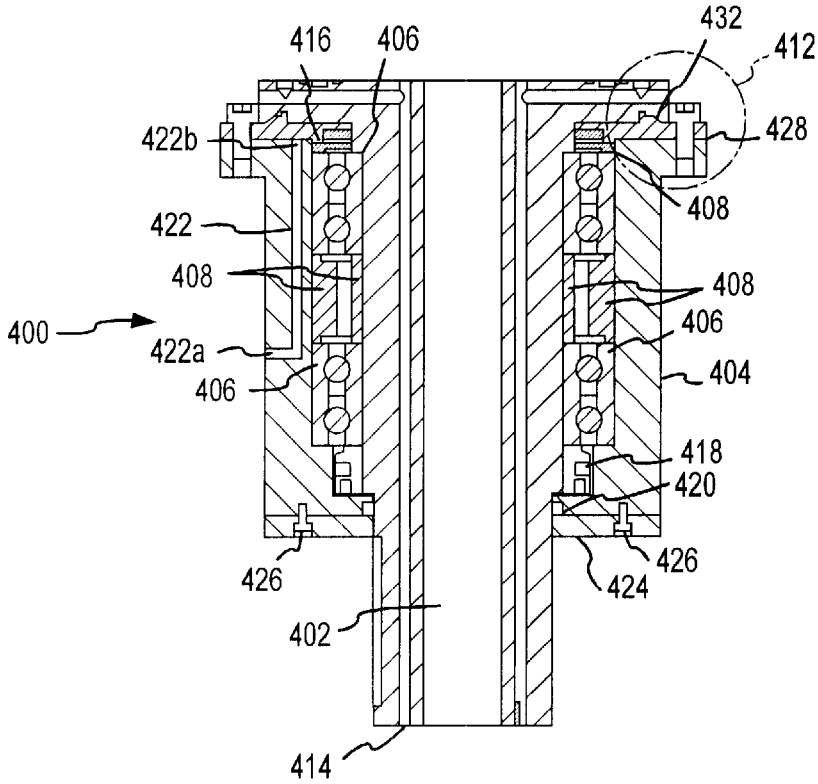
FIG. 4A is a cross-sectional view of a rotary shaft assembly incorporating an exemplary embodiment of the rotary shaft labyrinth seal of the present invention.

FIG. 4A illustrates an exemplary rotary shaft assembly 400 including an exemplary embodiment of a rotary shaft labyrinth seal of the present invention. As briefly mentioned above, as used herein, the term "labyrinth seal" is used to describe an exemplary seal in accordance with the present invention, though other seals which perform similar functions may be employed and still fall within the scope of the present invention. In the presently described exemplary embodiment, the rotary shaft assembly 400 includes a hollow, non-rotatable housing 404 which encases a plurality of components, such as internal bearings 406, spacers 408, lip seals 416, lock nuts 418, rod and piston seals 420, and a fluid purge line 422; a rotary shaft 402 which can include at least one fluid channel 414 extending therethrough and which passes through the housing 404 and is capable of rotation relative to the housing 404; a bottom plate 424 affixed to a lower portion of housing 404 with fasteners, such as screws 426; and a labyrinth seal 412 which can be coupled to housing 404 by any means known in the art, such as by silicon layer 428, for example.

Figure 4B:
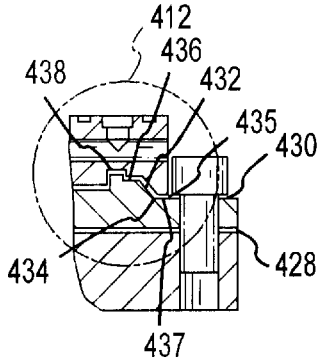
FIG. 4B is a close-up cross-sectional view of an exemplary embodiment of the rotary shaft labyrinth seal of FIG. 4A.

As better seen in FIG. 4B, the exemplary labyrinth seal 412 comprises a member, such as top plate 430, having at least one sloped surface or feature 432 which is configured to inhibit fluid from collecting at the entry of the labyrinth seal 412, from traveling or flowing into and/or through the labyrinth seal 412, and, ultimately, from contacting and accumulating on any of the interior components of the housing 404 of the rotary shaft assembly 400. Preferably, the labyrinth seal 412 includes one sloped feature. However, one skilled in the art will appreciate that the labyrinth seal 412 may include a plurality of sloped features, depending upon the particular application. In an exemplary embodiment, the sloped feature 432 is particularly directed toward inhibiting the accumulation of substrate processing fluid between rotating surfaces and among the bearings 406 of the rotary shaft assembly 400. One skilled in the art will appreciate that the term "fluid", as used herein, includes any suitable fluid used during a substrate finishing or polishing process, such as wet abrasive materials, chemical solutions, water, and/or the like, and may also include any vapors or gases associated with the use of such fluids. One skilled in the art further will appreciate that the term "sloped", as used herein, includes any suitable configuration for creating a path though the labyrinth seal 412 which directs a fluid to travel, flow, or otherwise move through the labyrinth seal 412 against the force of gravity. Thus, the term "sloped" may suitably include any planar or non-planar surface having a suitable slant, angle, incline, pitch, and/or the like. One skilled in the art further will appreciate that a suitable non-planar surface may include a suitably curved, rounded, or arcuate surface configuration; a notched, stepped, symmetrical or asymmetrical configuration; any suitable combination of these; and/or the like.

In an exemplary embodiment, the labyrinth seal 412 includes sloped surface 432 having a base 434 and an apex 436, wherein the base 434 juxtaposes the outer opening or entry 435 leading into the labyrinth seal 412. In another exemplary embodiment, the labyrinth seal 412 further includes a surface 437 which extends from the base 434 toward the opening or entry 435 of the labyrinth seal 412. The surface 437 may be any suitable surface, including a planar surface; a curved, arcuate, or other non-planar surface; a notched or stepped surface; any suitable combination of these; and/or the like. The surface 437 may be of any suitable length and may have either a suitable incline or a suitable decline. One skilled in the art will appreciate that the labyrinth seal 412 may also include a plurality of sloped surfaces 432, each having a base 434 and an apex 436, wherein the base 434 of at least one outermost sloped surface juxtaposes the opening or entry 435 leading into the labyrinth seal 412, and the base of additional, or inner, sloped surfaces juxtaposes an inwardly facing surface of an adjacent sloped surface or feature.

In an exemplary embodiment, the sloped surface or feature 432 is suitably configured such that the base 434 of the sloped feature 432 substantially inhibits the collection or pooling of fluid at the entry of the labyrinth seal 412. As illustrated in FIG. 4B, the sloped feature 432 may be an inclined, slanted, or angled path extending from a base 434 juxtaposing the entry or opening 435 of the labyrinth seal 412 to an apex 436 within the labyrinth seal 412. The sloped feature 432 may comprise any suitable slope, slant, incline, angle, pitch and/or the like. In an exemplary embodiment, the sloped feature 432 is configured to maximize the effect of the force of gravity on the fluid while maximizing the distance between the base 434 and the apex 436 of the sloped feature 432, for a given vertical height between the base 434 and the apex 436, and minimizing the profile and size of the labyrinth seal 412. Exemplary angles of sloped feature 432 may include angles of from about 100 to about 900 relative to a plane that is horizontal to the base 434. Preferably, the sloped feature 432 comprises an angle of from about 30° to about 60° relative to a plane that is horizontal to the base 434 and, more preferably, of from about 33° to about 36° relative to a plane that is horizontal to the base 434. The vertical height between the base 434 and the apex 436 of sloped feature 432 may be any suitable vertical height and may depend upon the particular application and/or whether other internal features are included in the labyrinth seal 412. Exemplary vertical heights between the base 434 and the apex 436 may include vertical heights of from about 2 millimeters to about 10 millimeters. Preferably, the vertical height between the base 434 and the apex 436 comprises a height of from about 3 millimeters to about 7 millimeters and, more preferably, from about 5 millimeters to about 6 millimeters. The apex 436 may be of any suitable configuration, such as a plateau, a pointed or triangular tip, a curvature, and/or the like.

Figure 4C:
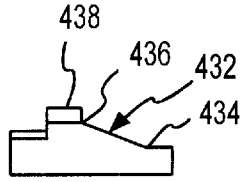
FIG. 4C is a close-up cross-sectional view of another exemplary embodiment of the rotary shaft labyrinth seal of FIG. 4A.

In another aspect of the present invention, the at least one sloped feature 432 may include an apex 436 coupled with a stepped-tooth 438. Stepped-tooth 438 may be of any suitable configuration and preferably is configured to maximize the effect of the force of gravity on the fluid by providing an additional obstacle to the flow of fluid through the labyrinth seal 412 and thereby further inhibiting or preventing the fluid from contacting any of the interior components of the rotary shaft assembly 400. In an exemplary embodiment, stepped-tooth 438 is suitably located above the apex 436. Stepped-tooth 438 may have any suitable dimensions. Exemplary dimensions of stepped-tooth 438 include a height of from about 0 millimeters to about 10 millimeters and a length of from about 0 millimeters to about 10 millimeters. Preferably, stepped-tooth 438 is from about 1 millimeter to about 5 millimeters in height and from about 2 millimeter to about 7 millimeters in length and, more preferably, from about 2 millimeters to about 3 millimeters in height and from about 5 millimeters to about 6 millimeters in length. In an exemplary embodiment, apex 436 may be of any suitable configuration which is compatible with the dimensions and functioning of the stepped-tooth 438, such as a plateau or other substantially level surface which contacts the base of the stepped-tooth 438, as seen in FIG. 4B, or an incline which directly abuts a portion of the stepped-tooth 438, as seen in FIG. 4C.

In accordance with yet another aspect of the present invention, the rotary shaft assembly 400 further comprises a fluid purge system configured to further inhibit the flow of fluid past the sloped feature 432, thereby assisting in decreasing the contamination of the interior components of the rotary shaft assembly 400 and the accumulation of fluid among the bearings 406 in the housing 404 of the rotary shaft assembly 400. In an exemplary embodiment, pressurized fluid (not shown) is introduced into the labyrinth seal 412 through fluid purge line 422 to provide a positive pressure along the sloped feature 432 and against the flow of fluid through the labyrinth seal 412. The fluid purge line 422 has a first end having an inlet 422*a* which is connected to a suitable source of pressurized fluid (not shown) and a second end having an outlet 422*b* terminating in the labyrinth seal 412. In an exemplary embodiment, fluid purge line 422 runs through any suitable portion of the rotary shaft assembly 400. In another exemplary embodiment, fluid purge line 422 runs through a suitable portion of the housing 404. The outlet 422*b* may be positioned at any suitable location within the labyrinth seal 412. In an exemplary embodiment, the outlet 422*b* is located within the labyrinth seal 412, distal from entry 435 and downstream of sloped feature 432. In another exemplary embodiment, outlet 422*b* is distal of entry 435 and rearward or downstream of stepped-tooth 438. Outlet 422*b* may have any suitable orientation with respect, to the labyrinth seal 412. For example, outlet 422*b* may be at an angle to the labyrinth seal 412 or outlet 422*b* may enter the labyrinth seal 412 vertically.

Figure 5:
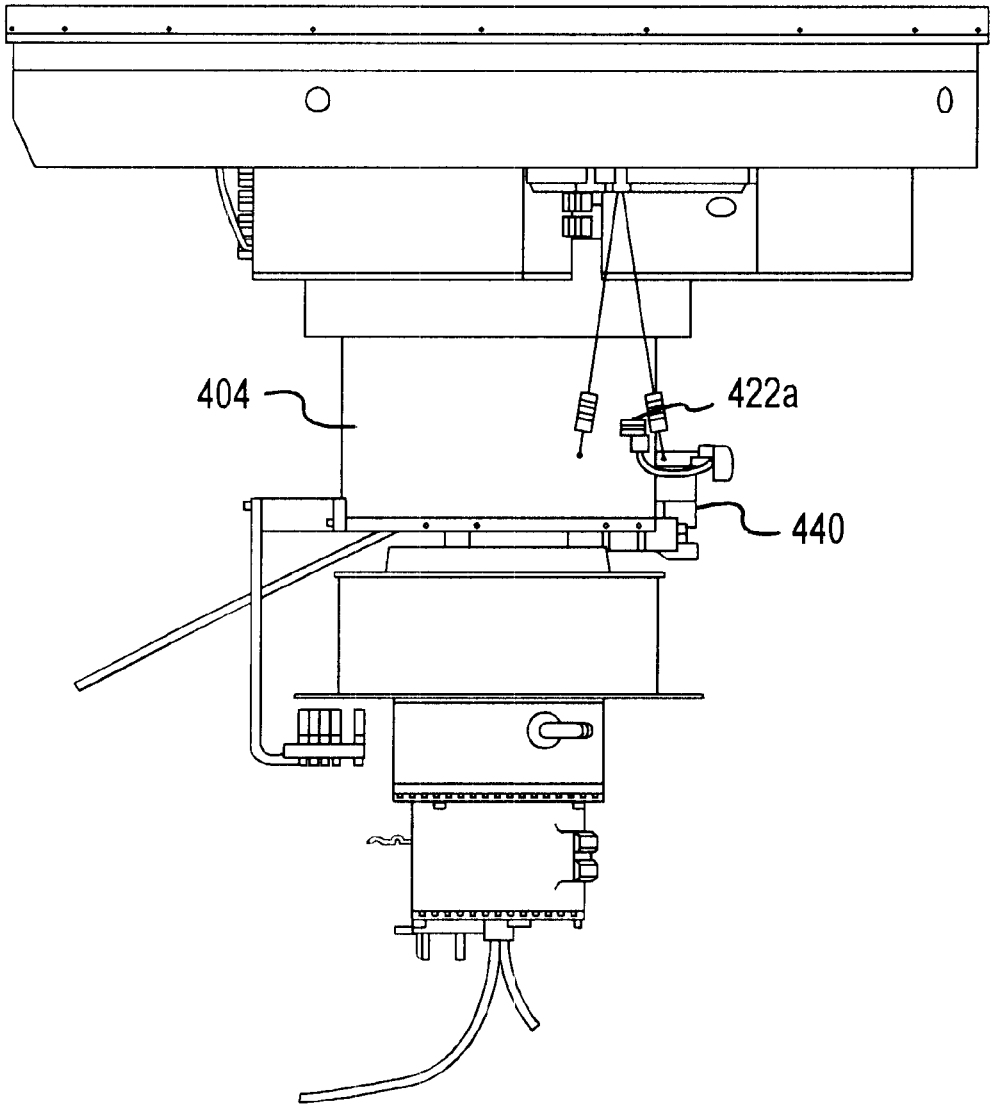
FIG. 5 is an exterior side view of an exemplary rotary shaft assembly.

The inlet 422*a* may be situated at any suitable location within or on the rotary shaft assembly 400. As seen in FIG. 5, an exemplary inlet 422*a* of fluid purge line 422 is suitably located on an exterior side portion of the housing 404. The source of pressurized fluid may be a container filled with the fluid or an apparatus which produces the fluid. The fluid may be any suitable pressurized fluid having any suitable pressure at the source of the fluid. The pressure of the fluid may be monitored by a regulator 440 located on an exterior side portion of the housing 404. In an exemplary embodiment, the fluid is a gas, such as nitrogen, wherein the nitrogen pressure at the source may be of from about 1 psi to about 5 psi. Preferably, the nitrogen pressure at the source is about 2 psi. In another exemplary embodiment, the pressurized fluid may be air, an inert gas, such as helium or argon, or a liquid, such as water, deionized water, and/or any other suitable solvent.

With momentary reference to FIG. 4, in accordance with still another aspect of the invention, the housing 404 of the rotary shaft assembly 400 may include a secondary seal 416 coupled to the labyrinth seal 412. Secondary seal 416 may be any suitable seal, such as a lip seal, a dual-lipped seal, an o-ring seal, a mechanical spring-energized energized seal, a wiper seal, a rod seal, and/or the like. In an exemplary embodiment, the secondary seal 416 is configured to substantially inhibit contact between the pressurized fluid introduced into the labyrinth seal 412 and the plurality of interior components, such as bearings 406, in the housing 404. Secondary seal 416 may be positioned at any suitable location within the rotary shaft assembly 400. In an exemplary embodiment, secondary seal 416 is located below the labyrinth seal 412 and above the internal bearings 406.

The labyrinth seal of the present invention may be made of any suitable material, such as steel, steel alloys, or other materials that are acceptable for use in the substrate finishing, planarization, or polishing environment.

While the invention has been particularly shown and described above with reference to exemplary embodiments, it will be understood by those skilled in the art that various changes in form and detail may be made without departing from the spirit and the scope of the present invention and that the invention encompasses all such modifications. No single feature, function, or property of any disclosed embodiment is essential to the practice of the present invention unless specifically described herein as "essential" or "critical".

What is claimed is:

1. A labyrinth seal for use in a rotary shaft assembly of a workpiece polishing apparatus, the labyrinth seal comprising:

a sloped surface having a base, an apex, and at least one stepped-tooth, wherein said base juxtaposes an opening of the labyrinth seal.

2. The labyrinth seal of claim 1, wherein said at least one stepped-tooth is connected to said apex of said sloped surface.

3. The labyrinth seal of claim 2, wherein said at least one stepped-tooth is located above said apex of said sloped surface.

4. A labyrinth seal for use in a rotary shaft assembly of a workpiece polishing apparatus, the labyrinth seal comprising:

a sloped surface having a base and an apex, wherein said base juxtaposes an opening of the labyrinth seal; and a fluid purge system terminating in the labyrinth seal, wherein said purge system provides a positive pressure along said sloped surface and against a direction of fluid flow.

5. The labyrinth seal of claim 4, wherein said fluid purge system comprises a purge line having a first end connected to a source of pressurized fluid and a second end terminating in the labyrinth seal.

6. The labyrinth seal of claim 5, wherein said pressurized fluid is a gas comprising at least one of nitrogen, air, helium, and argon.

7. The labyrinth seal of claim 5, wherein said pressurized fluid is a liquid comprising at least one of water and a solvent.

8. A labyrinth seal for use in a rotary shaft assembly of a workpiece polishing apparatus, the labyrinth seal comprising:

a member having at least one sloped feature, said at least one sloped feature being configured such that a fluid at an opening to the labyrinth seal contacts a base of at least one sloped feature, thereby inhibiting a fluid from traveling through the labyrinth seal.

9. A labyrinth seal for use in a rotary shaft assembly of a workpiece polishing apparatus, the labyrinth seal comprising:

a member having at least one sloped feature which is configured to inhibit a fluid from traveling through the labyrinth seal, said at least one sloped feature having at least one stepped-tooth.

10. The labyrinth seal of claim 9, wherein said at least one stepped-tooth is connected to an apex of said at least one sloped feature.

11. The labyrinth seal of claim 10, wherein said at least one stepped-tooth is located above said apex of said at least one sloped feature.

12. A labyrinth seal for use in a rotary shaft assembly of a workpiece polishing apparatus, the labyrinth seal comprising:

a member having at least one sloped feature which is configured to inhibit a fluid from traveling through the labyrinth seal; and a fluid purge system terminating in the labyrinth seal, wherein said purge system provides a positive pressure along said at least one sloped feature and against a direction of fluid flow.

13. The labyrinth seal of claim 12, wherein said fluid purge system comprises a purge line having a first end connected to a source of pressurized fluid and a second end terminating in the labyrinth seal.

14. The labyrinth seal of claim 13, wherein said pressurized fluid is a gas comprising at least one of nitrogen, air, helium, and argon.

15. The labyrinth seal of claim 13, wherein said pressurized fluid is a liquid comprising at least one of water and a solvent.

16. A workpiece polishing apparatus including a rotary shaft assembly, the rotary shaft assembly comprising:

a housing;

a shaft extending longitudinally through said housing;

a platen coupled to an end of said shaft; and a labyrinth seal located in a space between said shaft and said housing, wherein said labyrinth seal comprises a member having at least one sloped feature which is configured to inhibit a fluid from traveling though said labyrinth seal.

17. The labyrinth seal of claim 16, wherein said at least one sloped feature is configured such that fluid at an opening to the labyrinth seal contacts a base of at least one sloped feature.

18. The workpiece polishing apparatus of claim 16, further comprising at least one stepped-tooth coupled with said member.

19. The workpiece polishing apparatus of claim 18, wherein said at least one stepped-tooth is coupled to an apex of said at least one sloped feature.

20. The workpiece polishing apparatus of claim 19, wherein said at least one stepped-tooth is located above said apex of said at least one sloped feature.

21. The workpiece polishing apparatus of claim 16, further comprising a fluid purge system connected to said member, wherein said purge system provides a positive pressure along said at least one sloped feature and against a direction of fluid flow.

22. The workpiece polishing apparatus of claim 21, wherein said fluid purge system comprises a purge line having a first end connected to a source of pressurized fluid and a second end terminating in said labyrinth seal.

23. The workpiece polishing apparatus of claim 22, wherein said pressurized fluid is a gas comprising at least one of nitrogen, air, helium, and argon.

24. The workpiece polishing apparatus of claim 22, wherein said pressurized fluid is a liquid comprising at least one of water and a solvent.

25. The workpiece polishing apparatus of claim 21, wherein said housing further comprises a secondary seal coupled with said labyrinth seal, wherein said secondary seal is configured to inhibit contact between said pressurized fluid and a plurality of interior components of said housing.

26. The workpiece polishing apparatus of claim 25, wherein said secondary seal is a dual-lipped seal.

* * * * *